US007837580B2

(12) United States Patent
Huang et al.

(10) Patent No.: US 7,837,580 B2
(45) Date of Patent: Nov. 23, 2010

(54) LIGHTED NOCK FOR ARCHERY ARROW

(76) Inventors: Richard Huang, Mei Wah Court, tower 22, 7/F, Flat F, South Horizons, Ap Lei Chau, Hong Kong (CN); Dorge O'Some Huang, 615 Gateway Dr., Henry, IL (US) 61537-1001

( * ) Notice: Subject to any disclaimer, the term of this patent is extended or adjusted under 35 U.S.C. 154(b) by 542 days.

(21) Appl. No.: 11/845,332

(22) Filed: Aug. 27, 2007

(65) Prior Publication Data

US 2009/0062042 A1 Mar. 5, 2009

(51) Int. Cl.
*F42B 6/04* (2006.01)

(52) U.S. Cl. ..... 473/570; 473/578; 473/586

(58) Field of Classification Search ..... 473/570, 473/578, 585, 586
See application file for complete search history.

(56) References Cited

U.S. PATENT DOCUMENTS 4,340,930 A * 7/1982 Carissimi ..... 362/204
4,547,837 A * 10/1985 Bennett ..... 362/186
5,134,552 A * 7/1992 Call et al. ..... 362/203
6,123,631 A * 9/2000 Ginder ..... 473/570
6,390,642 B1 5/2002 Simonton
6,736,742 B2 * 5/2004 Price et al. ..... 473/570
7,316,625 B2 1/2008 Takahashi

* cited by examiner

*Primary Examiner*—John Ricci
(74) *Attorney, Agent, or Firm*—J. Nevin Shaffer, Jr.

(57) ABSTRACT

An archery arrow carries a light transmitting nock plus a light assembly, which comprises a light source positioned so that the light source is visible through the nock, a switch having normally open electrical contacts, and closable upon momentary contact with a magnetic field, and circuitry interconnecting a battery, the switch, and the light source for permitting illumination of the light source when the magnetic field is sensed. By this invention, the light assembly may be free of a housing and occupies a first bore of the nock and a second bore of the arrow shaft rearward end. A unique system for retaining a battery and protecting against high G force, plus a focused beam LED are other optional, advantageous features.

35 Claims, 4 Drawing Sheets

LIGHTED NOCK FOR ARCHERY ARROW

BACKGROUND OF THE INVENTION

In Simonton et al. U.S. Pat. No. 6,390,642 B1, an archery arrow is disclosed in which a magnetically actuated rear light is illuminated, as the arrow is fired from the bow.

Deer hunting, and other forms of hunting, can be a sport to which many are deeply dedicated. The rearwardly pointing light on the end of an arrow can show the hunter the path of the arrow and the place where it hits, whether it be the quarry, or another location. However, when the illuminated arrow strikes a target, it exhibits strong deceleration forces, which, in prior art systems, can cause the light to shut off in unplanned manner. This can be a huge disappointment to a sport hunter, who has invested heavily both financially and in time for the moment of arrow impact, and then the arrow light shuts off in unplanned manner. A sport hunter may actually be videotaping the process, and this can be hugely disappointing. When the arrow continues to emit light after having struck the target, subsequent movements of the quarry can be better traced and observed. Also, recovery of the arrow is facilitated when the target is missed, or upon a successful hit.

Furthermore, illuminated archery arrows in the past have emitted a significant portion of the light sideways through the transparent nock that they use. This light can be seen from the front, and may cause the quarry to start, resulting in a miss. At the same time, less light is projected directly rearwardly, so that the arrow becomes invisible at a shorter distance than in the situation where a very large portion of the light is directed rearwardly.

By this invention a lighted nock is provided for an arrow, in which an arrow carrying the nock spontaneously lights when subjected to a magnetic field as it is shot, but is less likely to accidentally, spontaneously light up because the arrow is jostled or dropped. Also, the light from this arrow can be more completely directed rearwardly for better visualization to the rear, and less ability to be seen by the target.

Also, the arrow of this invention is capable of withstanding greater G forces encountered during the arrow shot, particularly as the arrow hits the target, with the lighted nock being significantly lighter in weight than certain other prior art systems.

Thus, the reliability and utility of an arrow which utilizes a lighted nock of this invention is significantly improved.

DESCRIPTION OF THE INVENTION

By this invention, an archery arrow is provided which comprises: a shaft having forward and rearward portions, and having a rearwardly positioned tubular portion; a light transmitting nock attached to the rearward end of the shaft; a battery, which is typically carried in a hollow bore within the shaft; and a light assembly.

The light assembly, in turn, comprises: a light source positioned so that the light source is visible through the nock; a switch having normally open electrical contacts, the switch being closable upon momentary contact with a magnetic field; and circuitry interconnecting the battery, the switch, and the light source, for permitting illumination of the light source upon momentary sensing of the magnetic field.

In some embodiments, the light assembly of this invention may be free of the housing, and may occupy a first bore of the nock as well as a second bore of the arrow shaft rearward end.

The light transmitting nock may advantageously be permanently attached to the light assembly, this being done for example by a snap fit arrangement in which the light assembly fits into a bore of the light transmitting nock. This combined nock and light assembly can then be attached and detached as desired from the rest of the archery arrow, and may be sold separately. Conventional archery arrows may be used by removal of their conventional nock, if they are of a type that have a bore at the rear end thereof in which the battery and typically part of the light assembly can fit.

The arrow of this invention may be shot with a bow, in which the bow may desirably define an arrow rest structure attached to the bow and projecting laterally outwardly therefrom. The arrow rest structure may carry a magnet for activating the light assembly as an arrow is shot with the bow. Because the magnet is carried on the arrow rest structure and not the bow itself, the magnet may be placed closer to the arrow, so that the magnet may be momentarily closer than ½ inch to the light assembly as the arrow is shot from the bow. Thus, a momentarily stronger magnetic field may be imposed on the light assembly by this means, permitting use of a less sensitive magnetic switch. An advantage of this is that the light assembly is less likely to accidentally turn on through jostling or dropping of an arrow, while it still may be reliably turned on when fired by such a bow. However, the invention of this application may also be used with conventional bows having a conventionally-placed magnet.

In some embodiments, the light source may comprise a focused beam LED, of a commercially available type, under circumstances in which at least 90% of the light extends rearwardly at no more than a 40° angle from the axis of the arrow. This may be facilitated when the light source is in physical contact with a transparent, inner end wall of the nock, to minimize side scattering of light, rather than utilizing a spaced, air filled chamber between the light source and an inner end wall of a nock.

In some embodiments, the connected, light transmitting nock and the light assembly are interconnected, and retained together with a battery by a retaining wire which is attached to the nock and/or light assembly, for example by sealing or gluing to an inner wall of a bore of the nock. The battery may have a transverse groove, for example an annular groove. The retaining wire defines a first wire loop along an intermediate portion of the length of the wire. This first loop occupies the groove of the battery. The wire also may define a second loop that extends around the battery.

Preferably, the first wire loop also defines an overhand knot, which is like the simple first knot of a conventional shoelace tie, comprising a twist of the wires one or more times. The effect of this overhand knot, in the vicinity of and preferably occupying the battery groove, is to greatly increase the ability of the system to retain the battery in connected relation with the nock and light assembly, even under conditions of very high G force, for example when an arrow strikes bone in a quarry, and even when the arrow hits a rock or cement. The first loop occupying the groove helps to provide this significant improvement.

Also, the wire may define a second loop that extends around the battery, and provides further protection from G forces, particularly lateral force. In addition, an O ring may be placed around the battery to center and cushion it in the bore of the arrow itself, with the O ring being preferably large enough to sealingly engage both the battery and the inner wall of the arrow bore. The O ring may be thick for shock absorbing or thinner, like a rubber band.

Because of the above, the light assembly, which is retained in the nock, does not require an added, protective housing as in the prior art and, preferably no such housing is present. Instead, using the O ring, it is well cushioned and protected inside of the arrow and the nock.

In some embodiments, for the further avoidance of the effects of side impact, a conventional battery may be used where the entire battery housing is the positive terminal. The retaining wire with loops that wrap the battery also serves as a part of the circuit, connecting it at its other end to rest of the circuitry, which is typically placed in a circuit board and permanently attached to the nock. Thus, side impact typically has no effect of breaking the electric connection of the battery and the circuitry, and the lighting system functions normally under high impact conditions.

The circuitry used may comprises an analog design with digital components, using fuzzy logic. It avoids the problem of the prior art digital circuit, which loses its accuracy in the cold. One of the functions of the circuit is to hold the light in illuminated condition for a predetermined length of time, irrespective of the shock forces and the like that are encountered. Then, if desired, the circuit can be programmed to shut the light off.

DESCRIPTION OF THE DRAWINGS

Referring to the drawings.

DESCRIPTION OF THE SPECIFIC EMBODIMENTS

Figure 1:
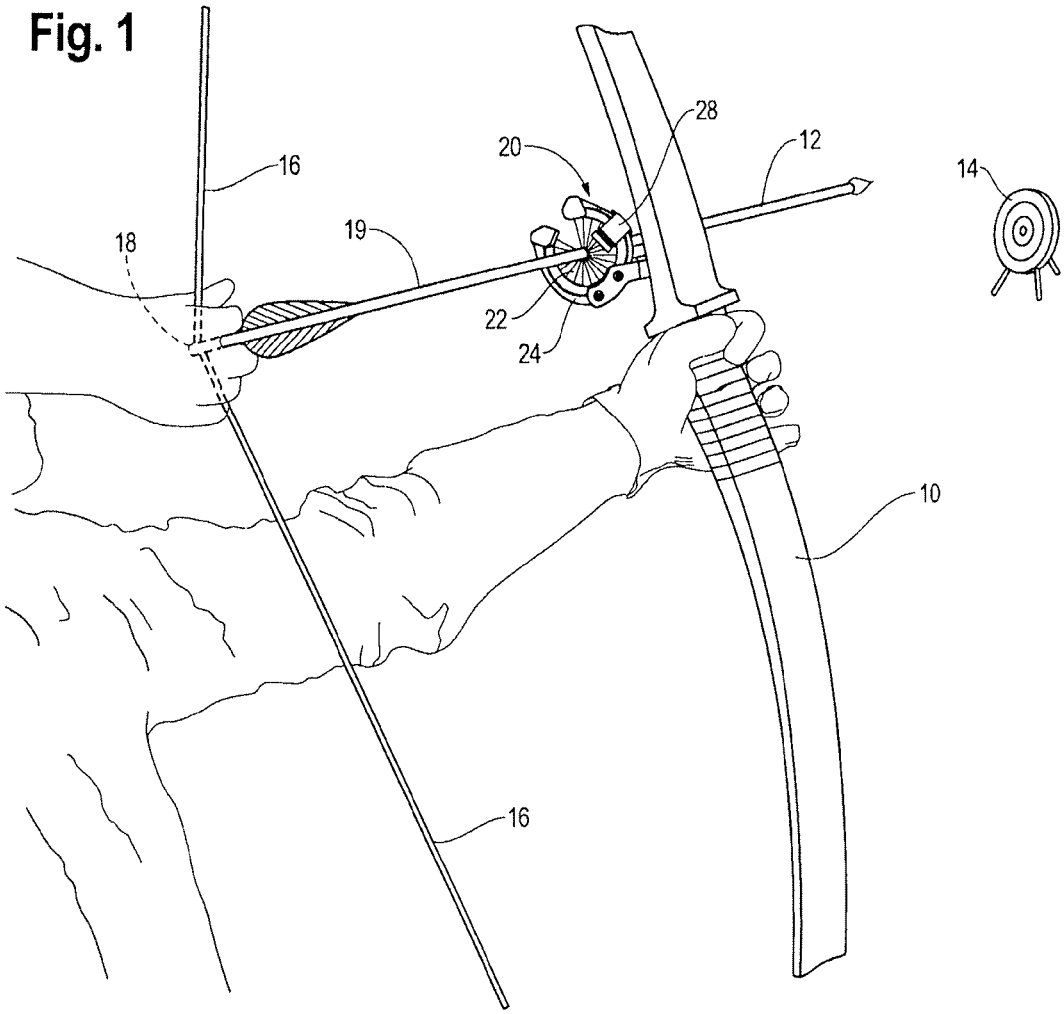
FIG. 1 is a fragmentary, perspective view of a deer hunting bow in which the arrow of this invention is placed, for shooting.
Figure 2:
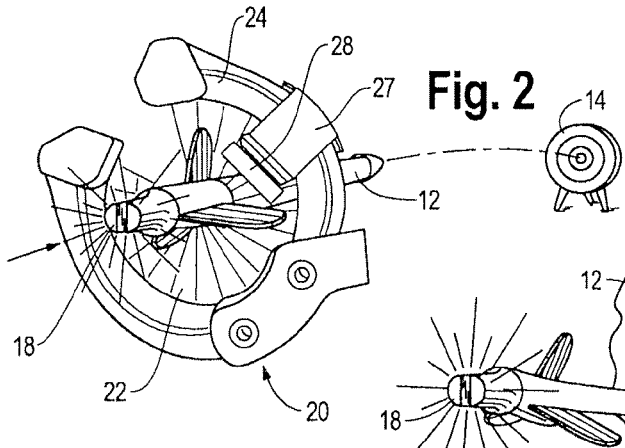
FIG. 2 is an enlarged, perspective view of the arrow rest carried on the bow of FIG. 1, showing placement of the actuating magnet in accordance with this invention.
Figure 3:
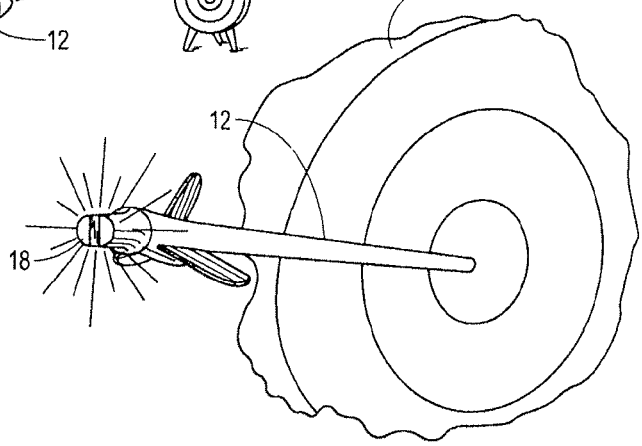
FIG. 3 shows the bow, with illuminated end, shot into a target.

Referring to the drawings, FIG. 1 is a fragmentary, perspective view of a bow 10 in which an archery arrow 12 is placed for shooting at a target 14. Bow 10 is often used for deer hunting and the like, as well as for target practice.

As of course has been conventional for thousands of years, bow string 16, attached to bow 10, is drawn back, with string 16 placed in a slot defined by nock 18 of arrow 12.

In this embodiment, a conventional arrow rest 20 is provided, through which arrow 12 penetrates, displacing brush like projections 22 which are separate from each other and attached at their outer ends to a ring-like frame 24. Arrow rest 20 is conventionally attached to bow 10, and provides precise placement of the arrow for improved accuracy in a known manner.

Figure 12A:
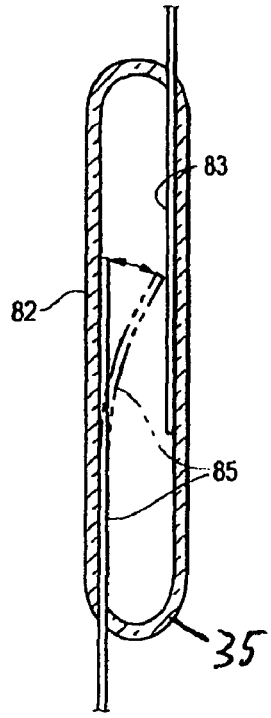
FIG. 12A is a diagrammatic view of a reed switch which may be used in this invention.

In this invention, nock 18 is light transmitting, being attached to the rearward end of arrow shaft 19. Magnet assembly 28 is attached by bracket 27 to arrow rest frame 24, projecting radially inwardly toward arrow 12, to provide a stronger magnetic field for more reliable light activation. Thus, as arrow 12 is shot, nock 18 passes rapidly through arrow rest 20, coming into proximity with magnet 28. The magnetic field turns on a light assembly carried at the rear end of arrow 12 in an improved manner, as described below, so that arrow 10, when it strikes target 14 (or not) rests with an illuminated arrow nock 18. The rear end of arrow 12 carries a battery 30 (FIG. 6), plus light assembly 32 which, in turn, comprises: a light source 34, positioned so that light source 34 is visible through transparent nock 18. A switch 35 (FIG. 12A) connects with circuitry 36, and may be of a reed switch type. Switch 35 has normally open electrical contacts, but is closeable upon momentary contact with a magnetic field. Circuitry 36 interconnects battery 30, switch 35 (within the circuitry), and light source 34, for permitting illumination of light source 34 upon momentary sensing of the magnetic field. Typically, circuitry 36 keeps light source 34 illuminated after the arrow has struck and is no longer moving, being, by this invention, particularly shock resistant and capable of staying illuminated under such conditions of significant longitudinal and/or transverse shock.

Figure 7:
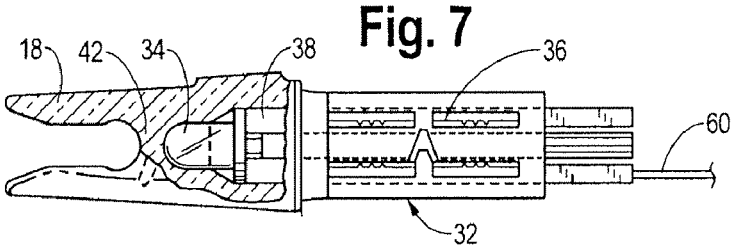
FIG. 7 is a fragmentary, longitudinal sectional view of the arrow of FIG. 6, rotated 90 degrees about its axis.

Furthermore, in some embodiments, light assembly 32 may be free of a housing, occupying a first bore 38 of arrow nock (FIG. 7) and a second bore 40 of the rearward end of the shaft of arrow 12. Light assembly 32 may be permanently attached to nock 18, but nock 18 and light assembly 32 may be removably attached, and detached, from the rest of arrow 12, as shown in FIG. 7.

By this invention, since magnet 28 may be mounted in an arrow rest such as the known arrow rest 24, it may be positioned to project near to the path of motion of arrow 12 through arrow rest 24, so that magnet 28 may be positioned to be momentarily closer than one half inch to light assembly 32 as arrow 12 is shot with bow 10. Because of this, a stronger magnetic field can be provided to the light illuminating system than in the prior art. For this reason, a reed switch 35 may be used which has less sensitivity to jarring at forces of the level which may be imparted to the arrow, as the arrow is being drawn out of its sheath and placed in the bow. Thus, light source 34 is less likely to illuminate as one is setting up to shoot, but light source 34 will be reliably illuminated when it passes closely by magnet 28, as can be reliably accomplished in accordance with this invention. Obviously, other means for operating closable switch 35 may be used as well including acceleration switches that close the switch 35 on acceleration and which require no magnets 28. Suitable acceleration switches are known such as the acceleration switch sold by Select Controls Inc. USA for example only and not by limitation.

Figure 4:
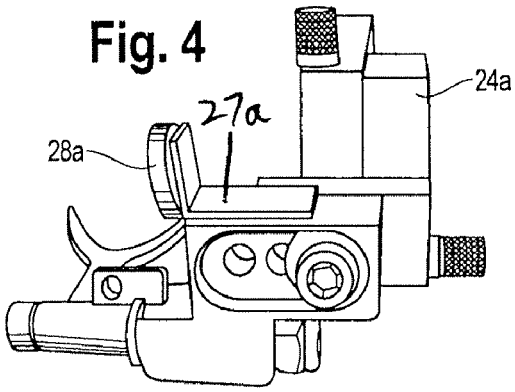
FIGS. 4 and 5 are perspective views of other embodiments of arrow rests that can carry a magnet in accordance with this invention in a position close to the arrow being shot.
Figure 5:
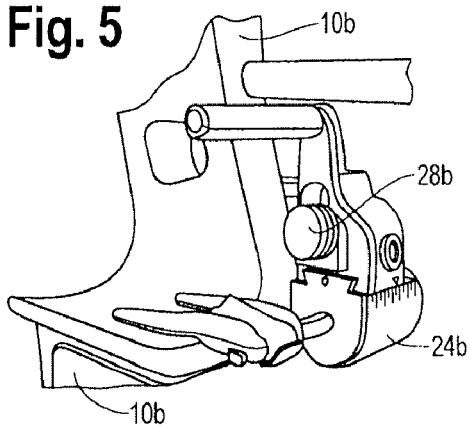

Other designs for an arrow rest are shown in FIGS. 4 and 5. In FIG. 4, actuator bracket 27*a* carries magnet 28*a* on arrow rest 24*a*, and may be mounted on a bow. In FIG. 5, arrow rest 24*b* is carried on bow 10*b*, and has a stack of two or more magnets 28*b*.

Light source 34 (FIG. 7) may comprise a focused beam LED in which at least 90 percent of the light extends rearwardly from nock 18 in no more than about a 40 degree angle from the axis of arrow 12. This is accomplished by the use of a focused beam LED, commercially available, in which LED 34 presses against internal transverse wall 42 of nock 18 without any space between them, as is done in the prior art. This provides greater visibility for the arrow directly behind it, and also provides a reduction of visibility of the arrow flying in the dusk forwardly along the path of the arrow.

Figure 9:
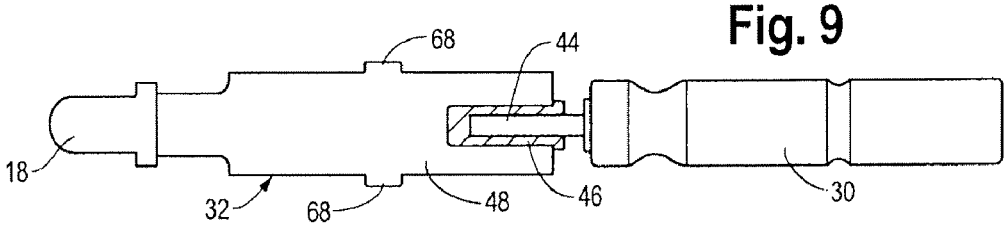
FIG. 9 is a fragmentary view of inner components of the arrow end as shown in FIG. 6, but rotated 90 degrees about the longitudinal axis from the position of FIG. 6.

Circuit board 36 is shown in separated manner in FIG. 9, connected to battery 30 by post 44, which is snugly fitted into recess 46 defined by a conventional support structure 48 as part of circuit board 36. However, the actual electrical connection may take place between wire 50, which is shown to be looped around battery 30 in FIG. 6, and which connects to the circuitry of circuit board 36, with the entire outer surface of battery 30 comprising an electrode. Retaining wire 50 thus interconnects and retains together battery 30 and light assembly 32, through circuit board 36, which may be in a rod-like form rather than being truly flat. Thus, light assembly 32 and circuitry 36 are connected to battery 30.

Figure 6:
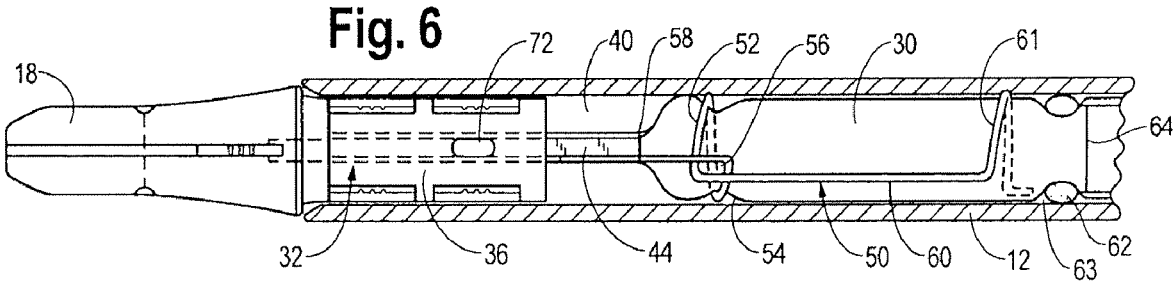
FIG. 6 is a partial, longitudinal section of the nock end of the arrow of FIG. 1.

Also, retaining wire 50 may define a first wire loop 52, which occupies a transverse, typically annular groove 54 in battery 30, along an intermediate portion of the length of wire 50. The purpose of loop 52 is to improve the retention between wire 50 and battery 30. This retention is further improved because first wire loop 52 defines an overhand knot 56, similar to the first knot of tying a shoe, in which the portion 58 of wire 50 which extends rearwardly from overhand knot 56 is blocked at overhand knot 56 from moving rearwardly by the presence of another portion 60 of wire 50, which extends forwardly as shown in FIG. 6. Such a simple overhand knot 56, placed in the wire loop 52 at groove 54, can provide significant increase in the retention strength of retaining wire 50, holding battery 30 in connecting relation with the remaining electrical components of the system. Furthermore, added reliability is provided when a (conventional) battery 30 is used having as a terminal its outer wall, and retaining wire 50 becomes part of the circuitry.

Furthermore, a second wire loop 61, spaced from first wire loop 52, is provided, with the wire extending around battery 30.

Figure 8:
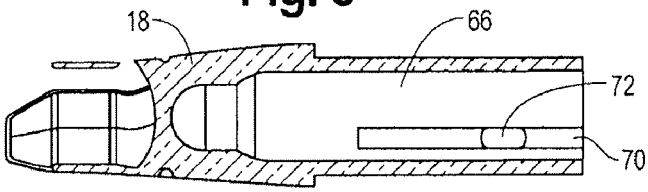
FIG. 8 is a fragmentary, longitudinal sectional view of the arrow nock of FIG. 7 with parts removed, rotated about 45 degrees about its axis from the position of FIG. 7.

Also, resilient O-ring 62 is provided nearer to the forward end 64 of battery 30, providing lateral cushioning and retention for the battery. This provides an arrow having an illuminated end which can stay lit even if subject to extreme forces, for example by striking bone or other hard targets. Light source 18 remains lit in a manner improved over the prior art. Light assembly 32 can fit into bore 66 of nock 18 (FIG. 8) by snap fit members 68, which may slide through groove 70 and enter into diametrically placed apertures 72 for connection between nock 18 and light assembly 32, with attached battery 30.

Figure 10:
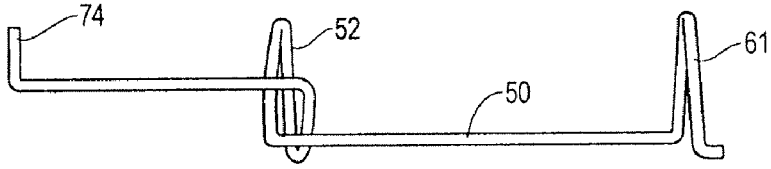
FIG. 10 is an elevational view of a retaining wire present in previous FIGS. 6 and 7.

Referring particularly to FIG. 10, retaining wire 50 is shown in a pre-assembly configuration. Bent end 74 can attach in an appropriate connection point to circuit board 36 to provide electrical connection between battery 30 and circuit board 36, to power the illumination of light source 34.

Figure 11A:
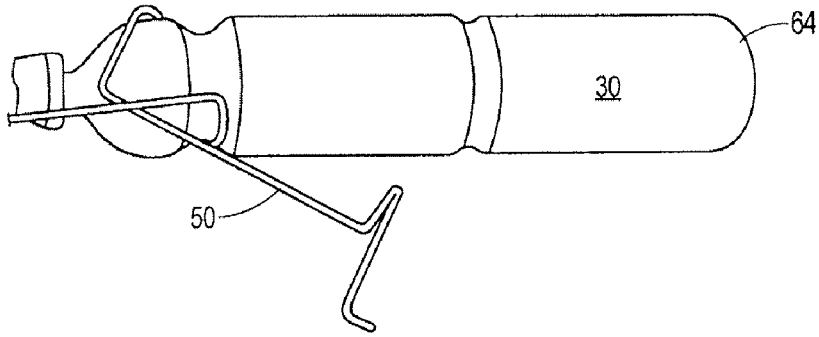
FIGS. 11A through 11D show steps of attachment of the retaining wire to a battery carried within the arrow.
Figure 11B:
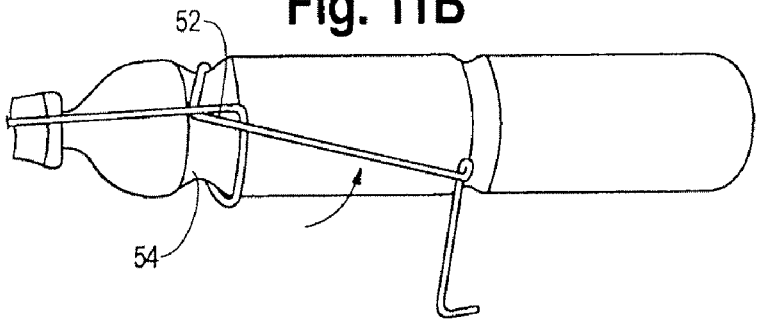
Figure 11C:
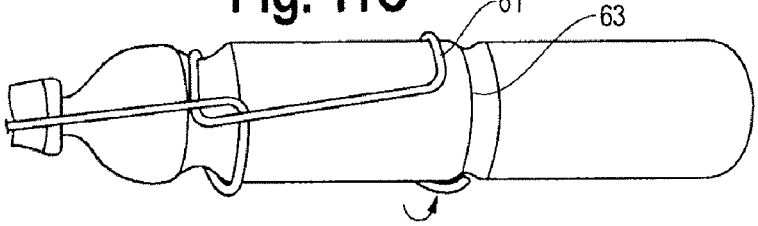
Figure 11D:
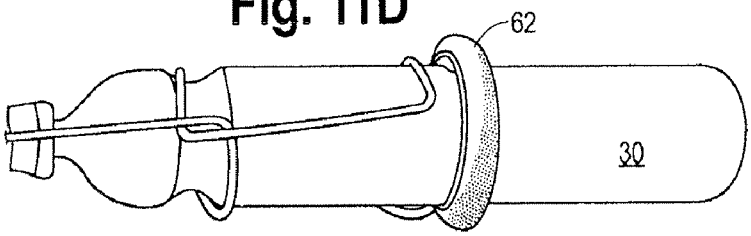

FIGS. 11A-11D show how retaining wire 50, attached to circuit board 36, can be attached to battery 30 in a series of steps, where, in FIG. 11B, first wire loop 52 is attached in first groove 54, and in FIG. 11C, second wire loop 61 is attached, but not placed in a groove 54 or 63. Second groove 63 instead receives O ring 62 for lateral reinforcement of battery 30, to increase lateral shock resistance.

Figure 12:
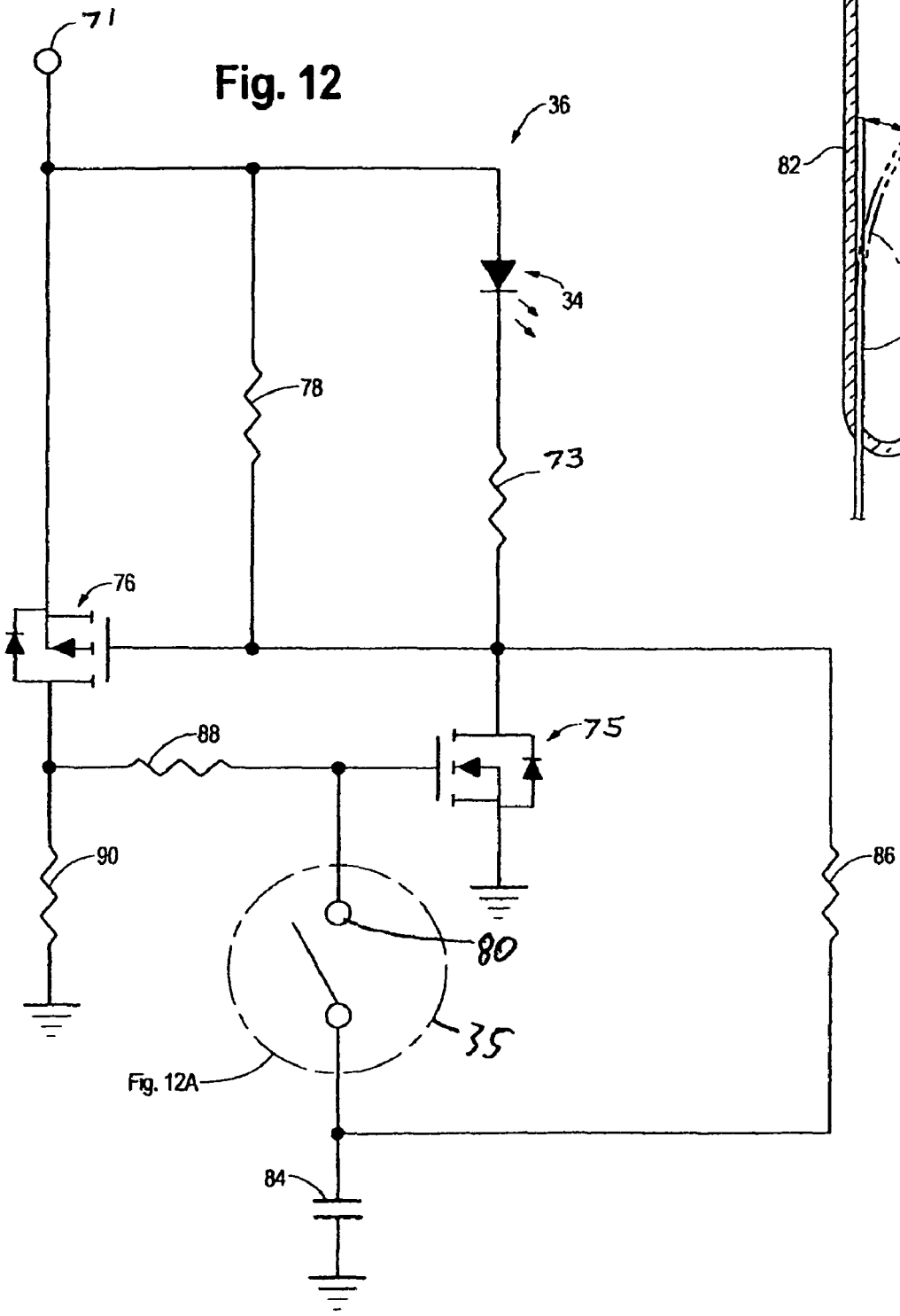
FIG. 12 is a circuit diagram of one embodiment of circuitry in this invention.

FIG. 12 shows circuitry 36 provided with the light assembly 32 and battery 30. This circuitry exhibits the function of (1) turning on light assembly 32 when reed switch 35 passes through the magnetic filed generated by magnet 28, while (2) keeping the LED lit under substantial shock force; and (3) enabling a user to turn off the LED after it is stationary for a short period of time, 4 or more seconds, and then turning it back on when it is again is exposed to a magnetic field or by any other known means such as by the force of acceleration. Thus, the arrow, after being shot, retains its light source in lit condition to assist in finding the arrow, but may be shut off by the archer by sweeping it near to magnet 28 carried on the bow, after the arrow has been stationary for a short period of time, or by operation of a predetermined time delay alone, for example only 4 or more seconds, or by providing force equal to the limit of the acceleration switch, such as by hitting the arrow on a hard surface, for example only and not by way of limitation.

An illustrative example of a circuit that can be used with the present invention is presented in FIG. 12. Referring to FIG. 12, the anode of an LED 34 is connected to one terminal 71 of battery voltage source 30. The cathode of LED 34 is connected through resister 73 to the drain of an N-channel mosfet 75, and to the gate of a P-channel mosfet 76. The source of mosfet 76 is connected to terminal 71 of the battery voltage source.

A resistor 78 is connected between terminal 71 and the gate of mosfet 76. The gate of mosfet 75 is connected to contact 80 of reed switch 82. The arm of reed switch 82 is connected to a capacitor 84, which is connected via resister 86 to the drain of mosfet 75 and the gate of mosfet 76. The gate of mosfet 75 is coupled to ground through a resister 88 and a resister 90 and the drain of mosfet 76 is coupled to ground via resister 90. Thus, the circuitry 36 can be understood to not drain power from the battery voltage source unless and until it is activated.

Reed switch 82 operates as both a relay and a motion sensor. If the system is off, once the system is tripped it will take a predetermined time interval, for example 4-8 seconds, for it to be returned to its off-stage. Likewise, if the system is in its on stage, once it is tripped it will take that predetermined time for it to be returned to its on stage. The use of mosfets aid in reducing the size of the system and the total power consumption, with the system not consuming any power when it is in the off stage.

One of the problems in certain prior art systems is that a simple impact force can cause the reed switch to change the state of the system from on to off. This can cause early battery burn out. For example, during an arrow flight towards an animal, in normal situations there are at least three shocks of impact. A first impact includes the arrow leaving the bow and the reed switch is being activated by the actuator magnet. The second impact could be the arrow encountering the animal and passing through the animal. The third impact could be the arrow hitting the ground. In prior art systems, the light may be turned on, then off, then on, then off, depending on each impact that passes over the threshold of the reed switch's impact tolerance. By the present invention, however, the time delay allows the system to be reset, with the reed switch behaving like a motion sensor. By the present invention, the LED remains lit during the various impacts.

The reed switch 82, it its initial condition, has reed connector wires 83, 85 that are in substantial contact with opposite sides of a chamber that contains the reed connector wires. The reed connector wires are made of magnetic, conductive material, and at least one of the reed connector wires is pivotal to move to engage the other reed connector wire in the presence of a magnetic field. Such a reed switch is commercially available, and provides reduced tendency to close and activate the light when the arrow which carries it is jostled or dropped. Thus, the resulting, illuminated arrow is less sensitive to accidental illumination, but reliably illuminates when it passes through the appropriate magnetic field upon firing of the arrow.

Thus, a bow and arrow system is provided in which the illuminated, transparent nock provides a desirable, rearwardly directed beam, but is of reduced weight compared with the prior art because of the absence of an independent housing. Also, the arrow system is subject to increased amounts of decelerative shock without causing the light source to shut off, while at the same time it is less sensitive to jostling and the like, to turn on the light source prior to shooting of the arrow, when compared with the prior art.

The above has been offered for illustrative purposes only, and is not intended to limit the scope of the invention of this application, which is as defined by the claims below.

That which is claimed is:

1. An archery arrow, which comprises:

a shaft having forward and rearward portions and having a rearwardly positioned tubular portion;

a light transmitting nock, with a transparent internal transverse wall, attached to the rearward end of the shaft;

a battery;

a light assembly comprising: a light source positioned so that the light source is in physical contact with said transparent internal transverse wall, a switch having normally open electrical contacts, said switch being closable, and circuitry interconnecting the battery, the switch, and the light source, for permitting illumination of the light source upon activation of said switch;

said light assembly being free of a housing, and occupying a bore of said arrow shaft rearward end and wherein the connected light transmitting nock and the light assembly are interconnected and retained together with a battery by a retaining wire which is attached to said nock and light assembly, said battery having a transverse groove, said retaining wire defining a first wire loop along an intermediate portion of the length of wire, said first loop occupying said groove, said wire also defining a second loop that extends around said battery.

2. The archery arrow of claim 1 in which said light transmitting nock is permanently attached to said light assembly, and said nock and light assembly can be attached and detached from the rest of said archery arrow.

3. The arrow of claim 1, in combination with a bow, said bow defining an arrow rest structure attached to the bow and projecting laterally outwardly therefrom, said arrow rest structure carrying a magnet for closing said switch and activating said light assembly as an arrow is shot with said bow.

4. The bow and arrow of claim 3 in which said magnet is momentarily closer than one half of an inch to said light assembly as the arrow is shot from said bow.

5. The arrow of claim 1 in which said light source comprises a focused beam LED and in which at least 90% of the light extends rearwardly in no more than a 40 degree angle from the axis of the arrow.

6. The arrow of claim 1 in which said circuit member is positioned between said light source and said battery.

7. The arrow of claim 1 in which said first wire loop defines an overhand knot.

8. The arrow of claim 1 in which said circuit member comprises:

a reed switch, and circuitry that remains "on" after activation by the reed switch under shock conditions that activate the reed switch to change its on-off state.

9. The arrow of claim 8 in which said reed switch in its initial condition has reed connector wires that are in substantial contact with opposite sides of a chamber that contains said reed connector wires, said reed connector wires being made of magnetic material, and at least one of said reed connector wires being pivotable to move to engage the other reed connector wire in the presence of a magnetic field.

10. The arrow of claim 1, in which the circuitry comprises a circuit board attached within said nock by snap fit members.

11. The archery arrow of claim 1 in which the closable switch is an acceleration switch and said closable switch is closed by the operation of said acceleration switch during acceleration.

12. The archery arrow of claim 1 in which said circuitry operates to open said switch and turn off said light source after a predetermined delay.

13. The archery arrow of claim 12 wherein said predetermined delay is four or more seconds.

14. The archery arrow of claim 1 wherein said circuitry operates to keep said circuit closed and said light source on once activated for a predetermined delay after activation.

15. The archery arrow of claim 14 wherein said predetermined delay is four or more seconds.

16. An integrally attached light transmitting nock, with a transparent internal transverse wall, for an archery arrow, said nock being permanently attached to a light assembly, in which the light assembly comprises:

a light source positioned so that the light source is in physical contact with said transparent internal transverse wall, a switch having normally open electrical contacts, said switch being closable, and circuitry interconnecting said switch and the light source with a battery for permitting illumination of the light of the light source upon activation;

said light assembly being free of a housing.

17. The combined nock and light assembly of claim 16 in which the light source comprises a focused beam LED.

18. The attached nock and light assembly of claim 16 which carries a retaining wire attached to said nock and light assembly, said retaining wire defining a first wire loop along an intermediate portion of the length of said wire for occupying a groove of a battery.

19. The attached nock and light assembly of claim 18 in which said wire also defines a second loop fore extending around said battery.

20. The attached nock and light assembly of claim 18 in which said first wire loop defines an overhand knot.

21. The attached nock and light assembly of claim 16 in which said circuit member comprises:

a reed switch, and circuitry that remains "on" after activation by the reed switch under shock conditions that activate the reed switch to change its on-off state.

22. The attached nock and light assembly of claim 21 in which said reed switch in its initial condition has reed connector wires that are in substantial contact with opposite sides of a chamber that contains said reed connector wires, said reed connector wires being made of magnetic material, one of said reed connector wires being pivotable to move to engage the other reed connector wire in the presence of a magnetic field.

23. The attached nock and light assembly of claim 16 in which said light source comprises a focused beam LED and in which at least 90% of the light extends rearwardly and no more than a 40 degree angle from the axis of the arrow.

24. The attached nock and light assembly of claim 23, in which the circuitry comprises a circuit board attached within said nock by snap fit members.

25. The archery arrow of claim 16 in which the closable switch is an acceleration switch and said closable switch is closed by the operation of said acceleration switch during acceleration.

26. The archery arrow of claim 16 in which said circuitry operates to open said circuit and turn off said light source after a predetermined delay.

27. The archery arrow of claim 26 wherein said predetermined delay is four or more seconds.

28. A light transmitting arrow nock, with a transparent internal transverse wall, for attachment to the rearward end of a shaft of an archery arrow, said nock being connected to a light assembly comprising:

a light source positioned so that the light source is in physical contact with said transparent internal transverse wall visible through the nock, a switch having normally open electrical contacts, said switch being closable, and circuitry interconnecting a battery, the switch, and the light source for permitting illumination of the light source upon activation, said light transmitting nock and light assembly carrying a retaining wire which extends rearwardly for attachment to a battery which is in connection with said light assembly, said retaining wire for retentively occupying a transverse groove of said battery.

29. The attached nock and light assembly of claim 28 in which said first wire loop defines an overhand knot for improvement of battery retention.

30. The attached nock and light assembly of claim 29 in which said wire also defines a second loop adjacent to a free end of said wire, said second loop being for extending around a battery that is connected to said light assembly.

31. The archery arrow of claim 28 in which the closable switch is an acceleration switch and said closable switch is closed by the operation of said acceleration switch during acceleration.

32. The archery arrow of claim 28 in which said circuitry operates to open said circuit and turn off said light source after a predetermined delay.

33. The archery arrow of claim 32 wherein said predetermined delay is four or more seconds.

34. An archery arrow, which comprises:

a shaft having forward and rearward portions;

a light transmitting nock attached to the rearward end of the shaft;

a battery;

a light assembly comprising: a light source positioned so that the light source is visible through the nock, a switch having normally open electrical contacts, said switch being closable, and circuitry interconnecting the battery, the switch, and the light source, for permitting illumination of the light source upon activation of said switch;

wherein the connected light transmitting nock and the light assembly are Interconnected and retained together with a battery by a retaining wire which is attached to said nock and light assembly, said battery having a transverse groove, said retaining wire defining a first wire loop along and intermediate portion of the length of wire, said first loop occupying said groove, said wire also defining a second loop that extends around said battery.

35. An archery arrow, which comprises:

a shaft having forward and rearward portions and having a rearwardly positioned tubular portion;

a light transmitting nock attached to the rearward end of the shaft;

a battery;

a light assembly comprising: a light source positioned so that the light source is visible through the nock, a switch having normally open electrical contacts, said switch being closable, and circuitry interconnecting the battery, the switch, and the light source, for permitting illumination of the light source upon activation of said switch;

wherein the circuitry comprises a circuit board attached with said nock by snap fit members.

* * * * *